US007583227B2

(12) United States Patent
Kuraoka et al.

(10) Patent No.: US 7,583,227 B2
(45) Date of Patent: Sep. 1, 2009

(54) ELECTRONIC DEVICE WITH BUILT-IN ANTENNA

(75) Inventors: Shinji Kuraoka, Kanagawa (JP); Yasuhito Omori, Kanagawa (JP)

(73) Assignee: Panasonic Corporation, Osaka (JP)

( * ) Notice: Subject to any disclaimer, the term of this patent is extended or adjusted under 35 U.S.C. 154(b) by 225 days.

(21) Appl. No.: 11/571,385

(22) PCT Filed: Jul. 6, 2005

(86) PCT No.: PCT/JP2005/012483

§ 371 (c)(1),
(2), (4) Date: Feb. 23, 2007

(87) PCT Pub. No.: WO2006/004153

PCT Pub. Date: Jan. 12, 2006

(65) Prior Publication Data

US 2008/0084355 A1 Apr. 10, 2008

(30) Foreign Application Priority Data

Jul. 6, 2004 (JP) ..... 2004-199628

(51) Int. Cl.
*H01Q 1/24* (2006.01)

(52) U.S. Cl. ..... 343/702; 343/895

(58) Field of Classification Search ..... 343/700 MS, 343/702, 895

See application file for complete search history.

(56) References Cited

U.S. PATENT DOCUMENTS

| | | | | |
|---|---|---|---|---|
| 6,239,765 | B1 * | 5/2001 | Johnson et al. | 343/795 |
| 6,894,651 | B2 * | 5/2005 | Yokochi et al. | 343/702 |
| 2003/0112200 | A1 * | 6/2003 | Marino | 343/824 |
| 2003/0195020 | A1 * | 10/2003 | Kubo | 455/575.1 |
| 2007/0063913 | A1 * | 3/2007 | Wu et al. | 343/824 |
| 2007/0096995 | A1 * | 5/2007 | Lee | 343/702 |

FOREIGN PATENT DOCUMENTS

| | | | |
|---|---|---|---|
| JP | 07-51809 | Y2 | 11/1995 |
| JP | 10-242732 | A | 9/1998 |
| JP | 2001-244731 | A | 9/2001 |
| JP | 2001-345621 | | 12/2001 |
| JP | 2003-229709 | A | 8/2003 |

* cited by examiner

*Primary Examiner*—HoangAnh T Le
(74) *Attorney, Agent, or Firm*—Pearne & Gordon LLP

(57) ABSTRACT

An antenna substrate (13) and a waveguide substrate (11) are housed in a main unit case (3). The waveguide substrate (11) is fixed to an attachment part (9) in the main unit case (3). The antenna substrate (13) is disposed adjacent to the waveguide substrate (11) in a standing position on the attachment part (9). The waveguide substrate (11) has an insert (33) on an edge (31) thereof. The antenna substrate (13) has a slit (37) aligned with the edge (31) of the waveguide substrate (11). The insert (33) is inserted into the slit (37), thereby restricting the movement of the antenna substrate (13). The antenna substrate (13) and the waveguide substrate (11) can be coupled to each other without using a metal plate bracket and integrally assembled to the main unit case (3). Therefore, the antenna performance is improved.

6 Claims, 5 Drawing Sheets

ELECTRONIC DEVICE WITH BUILT-IN ANTENNA

TECHNICAL FIELD

The present invention relates to an electronic device with a built-in antenna that has an antenna substrate and a waveguide substrate in a housing.

BACKGROUND ART

Conventional electronic devices with a built-in antenna have an antenna unit in a housing. For example, such an electronic device with a built-in antenna is a main device of a radio communication system used in a restaurant. For example, the antenna unit in the housing is composed of an antenna substrate on which an antenna pattern is formed. Such an antenna is disclosed in Japanese Patent Laid-Open No. 2001-345621.

A variety of electronic devices with a built-in antenna have already been put into practical use. Among these, an electronic device incorporates an antenna unit having an antenna substrate and a waveguide substrate. In this case, the antenna substrate and the waveguide substrate have to be in a predetermined positional relationship and make a predetermined angle with each other. Therefore, typically, the antenna substrate and the waveguide substrate are fixed to each other with a metal plate bracket.

As described above, in the conventional electronic device with a built-in antenna, the antenna substrate and the waveguide substrate are fixed to each other with a metal plate bracket. Therefore, the metal plate bracket has an effect on the coverage of the antenna and thus the performance of the antenna.

DISCLOSURE OF THE INVENTION

The present invention has been devised in view of such circumstances. An object of the present invention is to provide an electronic device with a built-in antenna the performance of which is improved because an antenna substrate and a waveguide substrate are fixed to each other without using a metal plate bracket.

An electronic device with a built-in antenna according to the present invention comprises: a housing; and an antenna substrate and a waveguide substrate both incorporated in the housing, in which one of the antenna substrate and the waveguide substrate is fixed to an attachment part in the housing, the other substrate is disposed adjacent to the one substrate and in a standing position on the attachment part, the one substrate has an insert on an edge thereof, the other substrate has a slit formed therein along the edge of the one substrate, and the insert is inserted into the slit.

Another aspect of the present invention is an antenna unit. The antenna unit comprises: an antenna substrate; and a waveguide substrate coupled to the antenna substrate, in which one of the antenna substrate and the waveguide substrate is fixed to an attachment part in a housing, the other substrate is disposed adjacent to the one substrate and in a standing position on the attachment part, the one substrate has an insert on an edge thereof, the other substrate has a slit formed therein along the edge of the one substrate, and the insert is inserted into the slit. Any device can be provided with the antenna unit.

According to another aspect of the present invention, there is provided a device with a built-in antenna comprising: a housing; and a first substrate and a second substrate both incorporated in the housing, in which the first substrate is fixed to an attachment part in the housing, the second substrate is disposed adjacent to the first substrate and in a standing position on the attachment part, the first substrate has an insert on an edge thereof, the second substrate has a slit formed therein along the edge of the first substrate, and the insert is inserted into the slit. The first substrate and the second substrate maybe a waveguide substrate and an antenna substrate but are not limited thereto.

As can be seen from the following description, the present invention has various other aspects. Thus, the disclosure of the present invention herein is intended to illustrate only some aspects of the present invention but not to limit the scope of the present invention described and claimed herein.

DESCRIPTION OF SYMBOLS

Figure 1:
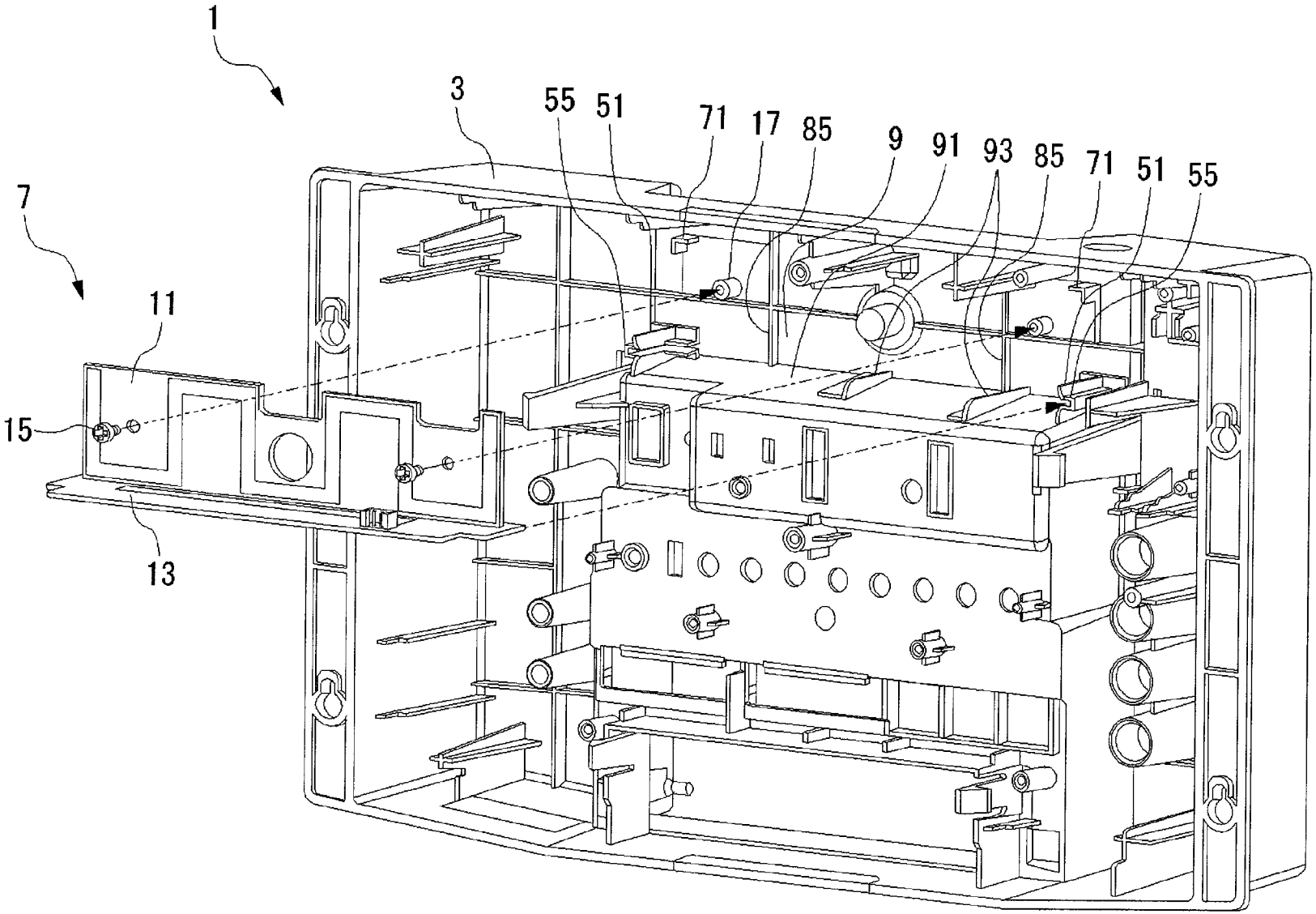
FIG. 1 is a diagram showing an electronic device with a built-in antenna according to an embodiment of the present invention.

1 electronic device with built-in antenna
3 main unit case
7 antenna unit
9 attachment part
11 waveguide substrate
13 antenna substrate
33 insert
35 engaging hook
37 slit
55 holding groove

BEST MODE FOR CARRYING OUT THE INVENTION

In the following, the present invention will be described in detail. However, it is to be noted that the following detailed description and the accompanying drawings are not intended to limit the scope of the present invention. Instead, the scope of the present invention is defined by the accompanying claims.

An electronic device with a built-in antenna according to the present invention comprises: a housing; and an antenna substrate and a waveguide substrate both incorporated in the housing, in which one of the antenna substrate and the waveguide substrate is fixed to an attachment part in the housing, the other substrate is disposed adjacent to the one substrate and in a standing position on the attachment part, the one substrate has an insert on an edge thereof, the other substrate has a slit formed therein along the edge of the one substrate, and the insert is inserted into the slit.

In this arrangement, one of the substrates is fixed to the attachment part, and the other substrate is disposed in a standing position on the attachment part. In addition, the insert on the one substrate is inserted into the slit in the other substrate.

Thus, the one substrate restricts the movement of the other substrate. Therefore, the substrates can be integrally assembled to the housing without using a metal plate bracket to couple the substrates to each other.

In addition, the housing may have holding grooves extending in a direction away from the attachment part, and opposite edges of the other substrate may be inserted in the holding grooves. In this arrangement, the edges of the other substrate can be held by the holding grooves, so that the other substrate can be prevented from shaking. Furthermore, the holding grooves can suitably serve as guide grooves during assembly.

In addition, the insert on the one substrate may have an engaging hook for engaging with the slit in the other substrate. In this arrangement, the insert on the one substrate is hard to be disengaged from the slit in the other substrate, and thus the substrates are appropriately fixed to the attachment part.

In addition, the one substrate may have a first protrusion that is aligned with the insert and protrudes from the edge, the other substrate may have a second slit aligned with the slit and a second protrusion extending from the edge of the second slit to the inside of the second slit, and the second protrusion on the other substrate may be disposed at such a position that the second protrusion restricts the movement of the first protrusion on the one substrate in such a direction that the engaging hook is disengaged. In this arrangement, the substrates are temporarily fixed to each other before the substrates are attached to the housing. Therefore, the substrates can be easily assembled to the housing.

The one substrate may be the waveguide substrate, and the other substrate may be the antenna substrate. This arrangement will be described below as an embodiment of the present invention. Alternatively, the one substrate may be the antenna substrate, and the other substrate may be the waveguide substrate.

As described above, according to the present invention, one of the antenna substrate and the waveguide substrate has an insert, the other has a slit, and these elements are used to couple the substrates to each other. Any metal-plate coupling bracket is not needed. Thus, the antenna performance is improved.

In the following, an electronic device with a built-in antenna (referred to simply as electronic device hereinafter) according to an embodiment of the present invention will be described with reference to the drawings. In the following description, the appearance of the electronic device will be first mentioned with reference to FIGS. 6 and 7, and then an antenna unit incorporated in the electronic device will be mentioned with reference to FIGS. 1 to 5.

Figure 6:
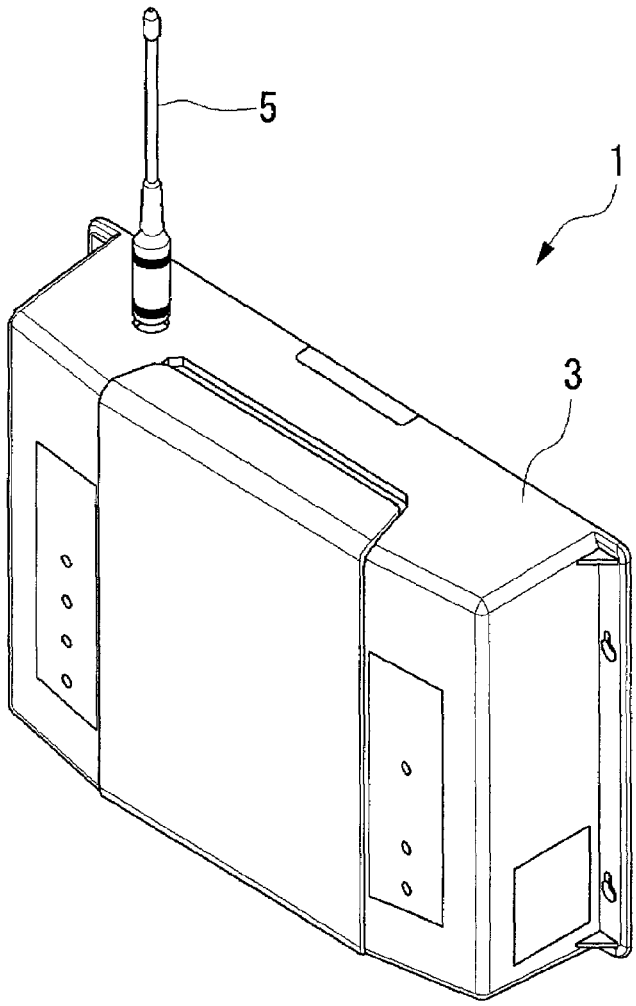
FIG. 6 is a front view of the electronic device with a built-in antenna.
Figure 7:
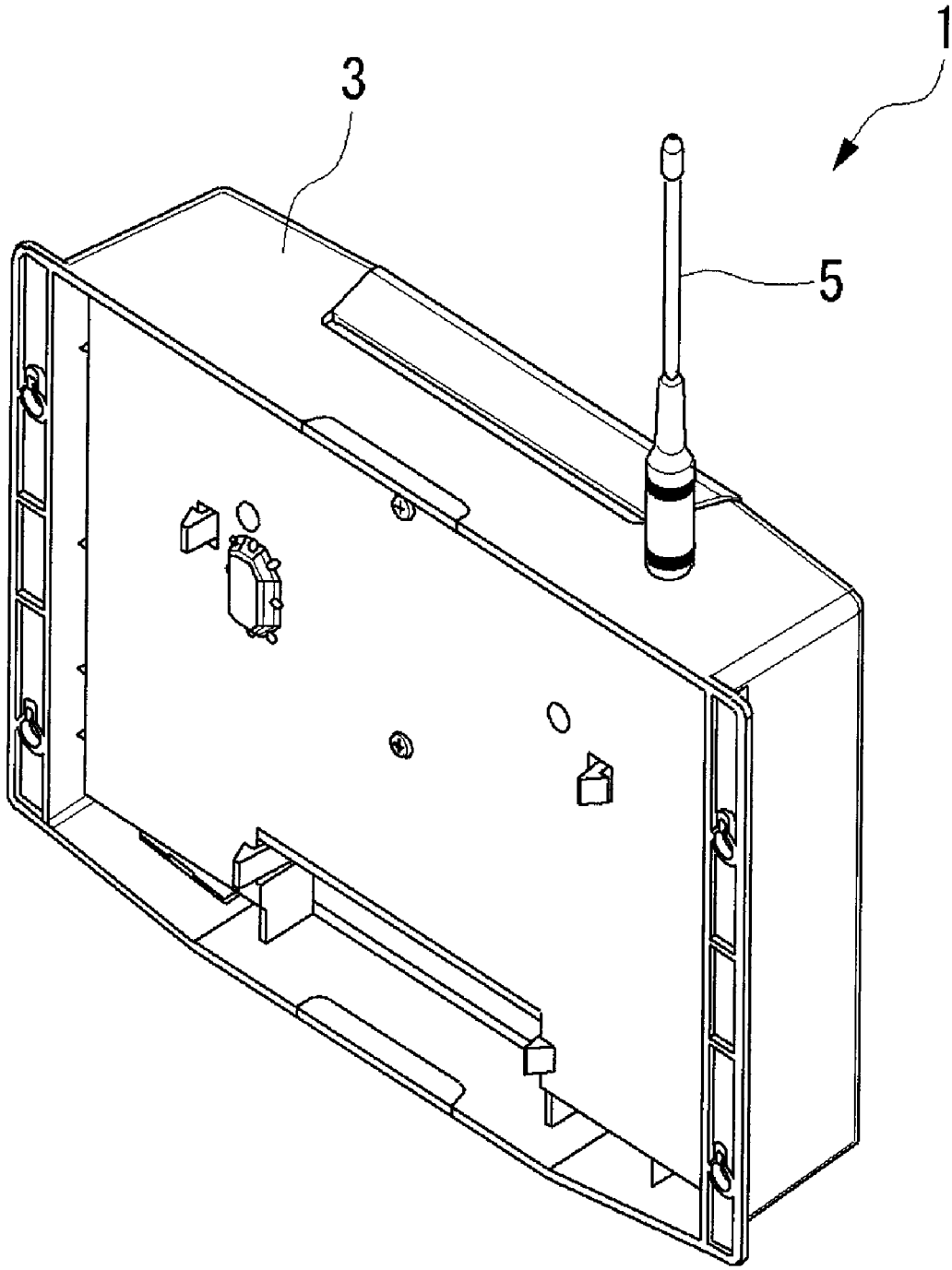
FIG. 7 is a rear view of the electronic device with a built-in antenna.

FIGS. 6 and 7 show the appearance of the electronic device according to this embodiment. FIGS. 6 and 7 are perspective views of the electronic device seen from the front and the rear, respectively. In this embodiment, the electronic device is a main device of a radio communication system used in a restaurant or the like. An electronic device 1 has a main unit case 3 serving as a housing. An external antenna 5 protrudes upward from the main unit case 3. In addition to the external antenna 5, another antenna unit is housed in the main unit case 3.

FIG. 1 is a perspective view of the inside of the main unit case 3 seen from the rear of the main unit case 3. The main unit case 3 is made of resin and formed by molding.

A built-in antenna unit 7 is fixed to an attachment part 9 in the main unit case 3. The attachment part 9 is constituted by the bottom surface of a laterally or horizontally elongated hollow formed in the middle and in the upper space of the main unit case 3.

The antenna unit 7 is composed of a waveguide substrate 11 (waveguide) and an antenna substrate 13. Two screws 15 pass through the waveguide substrate 11 and are fitted into bosses 17 on the attachment part 9. In this way, the waveguide substrate 11 is fixed to the attachment part 9. The antenna substrate 13, which is coupled to the waveguide substrate 11, abuts against the waveguide substrate 11 in a standing position on the attachment part 9. More specifically, the attachment part 9 is constituted by a substantially vertical wall. The waveguide substrate 11 is fixed to and along the wall, so that the waveguide substrate 11 is substantially in parallel with the wall. The antenna substrate 13 stands on the wall of the attachment part 9 substantially vertically. As a result, the antenna substrate 13 is substantially in parallel with the horizontal plane.

Figure 2:
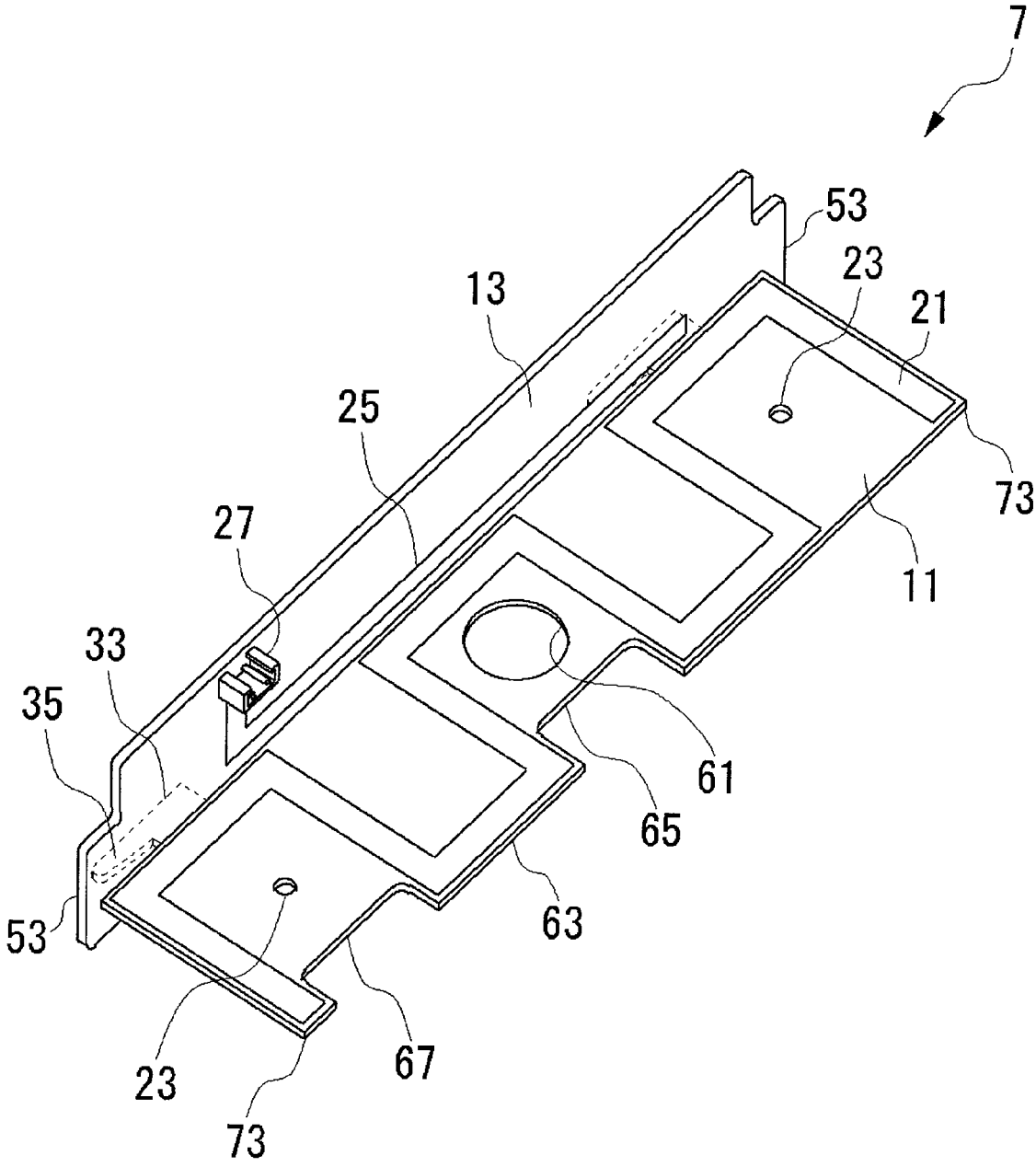
FIG. 2 is a perspective view of a waveguide substrate and an antenna substrate coupled to each other.
Figure 3:
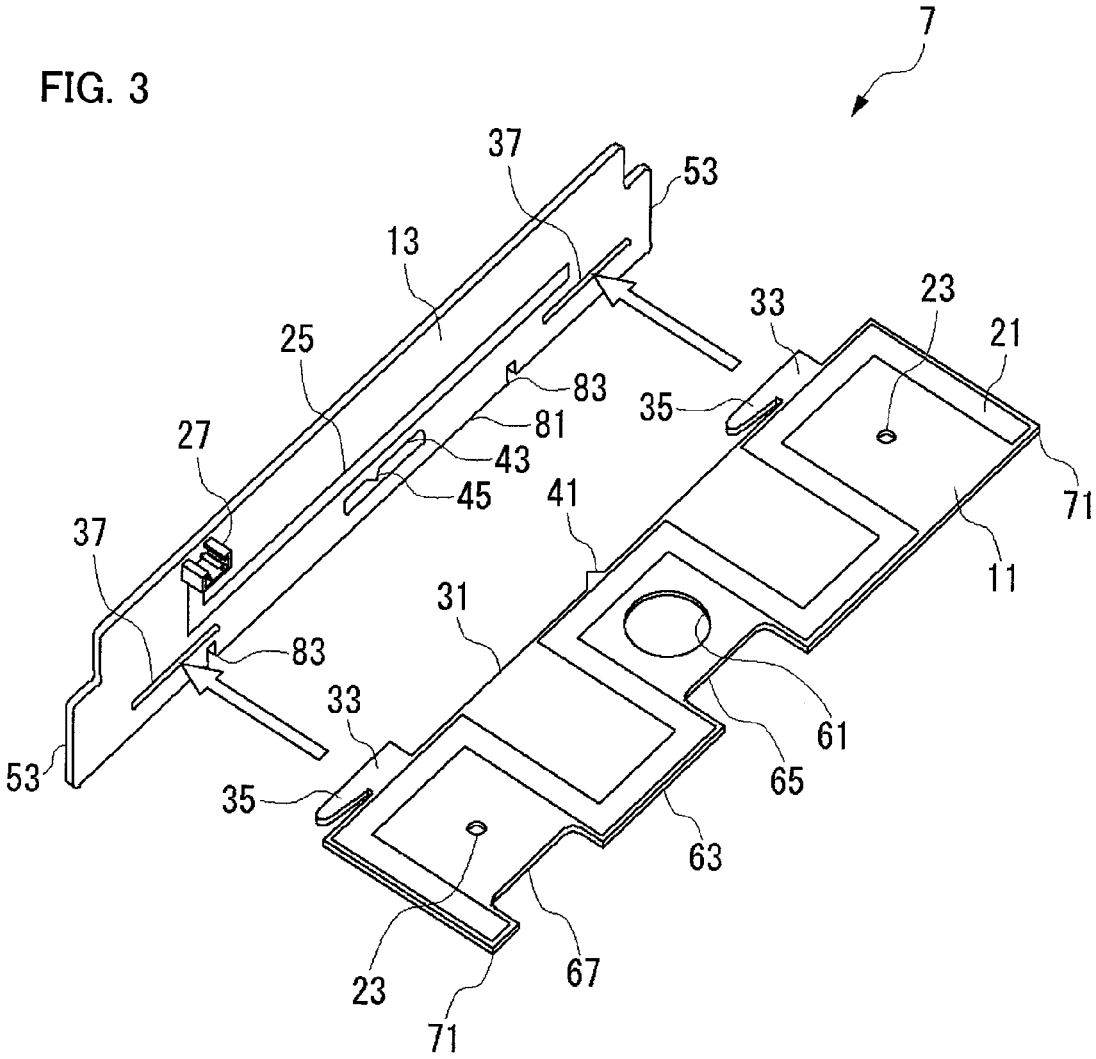
FIG. 3 is a perspective view of the waveguide substrate and the antenna substrate separated from each other.
Figure 4:
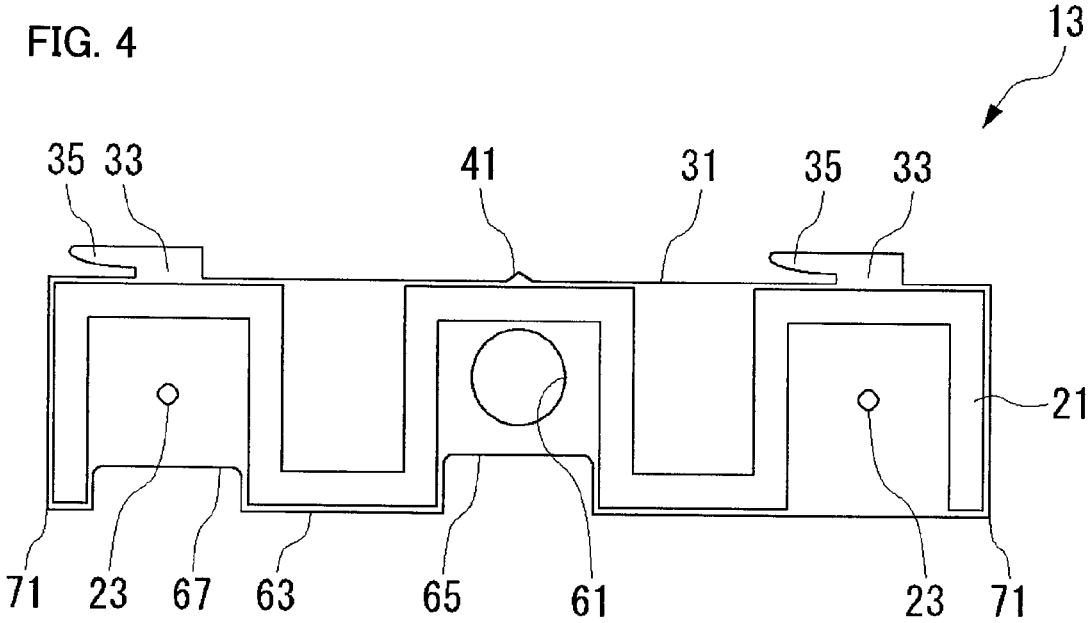
FIG. 4 is a diagram showing the waveguide substrate.
Figure 5:
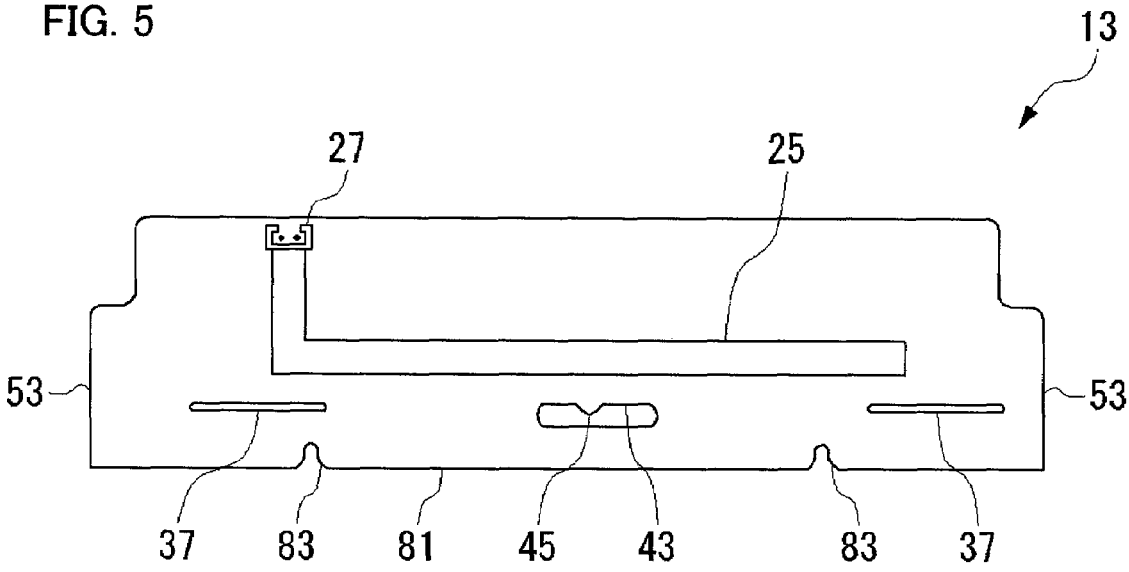
FIG. 5 is a diagram showing the antenna substrate.

FIGS. 2 to 5 show the antenna unit 7. FIGS. 2 and 3 show the antenna unit 7 coupled to each other and separated from each other, respectively. FIG. 4 shows the waveguide substrate 11, and FIG. 5 shows the antenna substrate 13.

As shown in these drawings, the waveguide substrate 11 and the antenna substrate 13 have an elongated rectangular shape. Both the substrates are made of epoxy or glass, for example. The substrates may be made of different materials. Furthermore, according to this embodiment, the substrates make a right angle with each other.

The waveguide substrate 11 has a waveguide pattern 21 formed on one side thereof. As shown, the waveguide pattern 21 includes a plurality of bends and extends in a zigzag manner with respect to the longitudinal direction. Screw holes 23 are formed spaced apart from the waveguide pattern 21. On the other hand, the antenna substrate 13 has a linear antenna pattern 25. The antenna pattern 25 is bent at one end thereof, and a connector 27 is attached to the tip of the bent end. The connector 27 is connected to a substrate in the main unit case 3 (not shown).

The waveguide substrate 11 is in contact with the antenna substrate 13 at an edge 31. Two inserts 33 are formed on the edge 31. The inserts 33 are protrusions extending outward from the edge 31 along the substrate surface. The two inserts 33 are spaced apart from each other in the longitudinal direction. More specifically, the two inserts 33 are formed near the opposite ends of the waveguide substrate 11, respectively.

Each insert 33 has an engaging hook 35. The engaging hook 35 is a part of the insert 33 protruding therefrom along the edge 31. The engaging hook 35 is substantially in parallel with the edge 31. The two engaging hooks 35 protrude in the same direction from the respective inserts 33.

The antenna substrate 13 has one slit 37 for each of the inserts 33 on the waveguide substrate 11 described above. Two slits 37 are formed at positions corresponding to those of the inserts 33. The inserts 33 are inserted into the slits 37. In this way, the antenna substrate 13 is coupled to the waveguide substrate 11.

In addition, the engaging hooks 35 of the inserts 33 are engaged with the slits 37 in the antenna substrate 13. More specifically, when the inserts 33 are inserted into the slits 37, the waveguide substrate 11 is slid with respect to the antenna substrate 13. This makes the engaging hooks 35 engage with the ends of the slits 37 in the antenna substrate 13.

In addition, the waveguide substrate 11 has a protrusion 41 (a first protrusion) that is aligned with the inserts 33 and protrudes outwardly from the edge 31. The protrusion 41 is formed midway between the two inserts 33 and substantially at the middle of the substrate.

On the other hand, the antenna substrate 13 has another slit 43 (a second slit with a protrusion or an auxiliary slit with a protrusion) at the position corresponding to the projection on the waveguide substrate 11. A protrusion 45 (a second protrusion) extends from the edge of the slit 43 toward the inside of the slit 43.

The protrusion 45 on the antenna substrate 13 is disposed to restrict or limit the movement of the waveguide substrate 11 in such a direction that the engaging hooks 35 are disengaged from the antenna substrate 13 as described below.

If the waveguide substrate 11 is slid with respect to the antenna substrate 13 in the removal direction that is opposite to the sliding direction at the time of assembly, the engaging hooks 35 are removed from the antenna substrate 13. To prevent the removal, the protrusion 45 on the antenna substrate 13 is located forward of the protrusion 41 on the waveguide substrate 11 along the removal direction described above. As a result, if the waveguide substrate 11 is to slide in the removal direction (in such a direction that the hooks are removed from the antenna substrate), the protrusion 41 on the waveguide substrate 11 comes into contact with the protrusion 45 on the antenna substrate 13 and is prevented from moving further. This feature is advantageous during assembly as described later. During assembly, the protrusions can be used to temporarily secure the substrates to each other.

In the arrangement described above, after the substrates are coupled to each other, the protrusions 41 and 45 may be in contact with each other or slightly spaced apart from each other.

Now, a structure for supporting the antenna substrate 13 will be described. With reference to FIG. 1, two supporting columns 51 are formed on the attachment part 9 in the main unit case 3. The two supporting columns 51 are formed at the positions corresponding to opposite edges 53 of the antenna substrate 13. Each supporting column 51 has a holding groove 55. The holding grooves 55 extend in a direction away from the attachment part 9. The edges 53 of the antenna substrate 13 are inserted into the holding grooves 55. In this way, the antenna substrate 13 is supported by the holding grooves 55 at the opposite sides thereof.

In addition, the waveguide substrate 11 has a clearance hole 61 substantially at the center thereof. A protrusion on the main unit case 3 is received in the clearance hole 61. In addition, the waveguide substrate 11 has clearance recesses 65 and 67 in an edge 63 opposite to the edge 31. Protrusions on the main unit case 3 are received also in the clearance recesses 65 and 67.

In addition, angled protrusions (or corner protrusions) 71 are formed on the attachment part 9 in the main unit case 3. The angled protrusions 71 are formed at the position corresponding to corners 73 of the waveguide substrate 11. The angled protrusions 71 are used when attaching the waveguide substrate 11 to the attachment part 9. During attachment, the waveguide substrate 11 is disposed in such a manner that the corners 73 are located inside the angled protrusions 71.

In addition, two slit-like notches 83 are formed in a lower edge 81 of the antenna substrate 13. Ribs 85 on the attachment part 9 in the main unit case 3 are fitted into the notches 83.

In addition, two ribs 93 are formed on a wall 91 in the main unit case 3. The wall 91 extends along the backside of the antenna substrate 13. The ribs 93 extend along the wall 91 in a direction away from the attachment part 9. The ribs 93 are in contact with the backside of the antenna substrate 13 and support the antenna substrate 13.

An arrangement of the electronic device according to this embodiment has been described particularly with regard to the antenna unit 7 and the attachment structure therefor. In the following, a method of assembly of the electronic device according to this embodiment will be described.

First, the waveguide substrate 11 and the antenna substrate 13 are coupled to each other. In this step, the waveguide substrate 11 and the antenna substrate 13 are disposed at right angles to each other. The inserts 33 on the waveguide substrate 11 are inserted into the slits 37 in the antenna substrate 13. The waveguide substrate 11 is inserted until the edge 31 of the waveguide substrate 11 comes into contact with the antenna substrate 13. When the inserts 33 are inserted into the slits 37, the protrusion 41 on the waveguide substrate 11 is inserted into the slit 43 in the antenna substrate 13 at the same time.

Then, the waveguide substrate 11 and the antenna substrate 13 are slid with respect to each other, thereby sliding the inserts 33 in the slits 37. This makes the engaging hooks 35 catch the ends of the slits 37 and engage with the antenna substrate 13.

In the sliding step described above, the protrusion 41 on the waveguide substrate 11 moves within the slit 43 in the antenna substrate 13 and comes into contact with the protrusion 45 in the slit 43. The protrusion 41 moves over the protrusion 45 and reaches to the other side thereof. When the protrusion 41 moves over the protrusion 45, the waveguide substrate 11 is slightly bent and elastically deformed. This enables the protrusion 41 to move through the clearance beside the protrusion 45 and past the protrusion 45 within the slit 43.

The waveguide substrate 11 and the antenna substrate 13 are coupled to each other as described above. Then, the substrates 11 and 13 coupled to each other are assembled to the main unit case 3.

In the assembly step, the opposite edges 53 of the antenna substrate 13 are inserted into the holding grooves 55 on the supporting columns 51 in the main unit case 3. The antenna substrate 13 and the waveguide substrate 11 are guided by the holding grooves 55 toward the attachment part 9.

When the edges 53 of the antenna substrate 13 are inserted to an appropriate position in the holding grooves 55, the waveguide substrate 11 reaches the attachment part 9. At this time, the corners 75 of the waveguide substrate 11 are disposed inside the angled protrusions 71 on the main unit case 3. The screw holes 23 in the waveguide substrate 11 are aligned with the bosses 17 on the main unit case 3. In addition, the clearance hole 61 and the clearance recesses 65 and 67 in the waveguide substrate 11 receive the corresponding protrusions on the main unit case 3. In addition, the ribs 85 on the main unit case 3 are fitted into the notches 83 in the edge 81 of the antenna substrate 13. In addition, the ribs 93 on the main unit case 3 abut against the backside of the antenna substrate 13.

Then, the waveguide substrate 11 is fixed to the attachment part 9 with the screws 15. Thus, the antenna unit 7 composed of the waveguide substrate 11 and the antenna substrate 13 is assembled to the main unit case 3. Once assembled, the movement of the antenna substrate 13 is restricted by the waveguide substrate 11 and the main unit case 3. Specifically, the inserts 33 on the waveguide substrate 11, which are inserted in the slits 37 in the antenna substrate 13, prevent the antenna substrate 13 from moving away from the attachment part 9. In addition, the engaging hooks 35 of the inserts 33, which engage with the antenna substrate 13, restrict the movement of the antenna substrate 13 in the lateral or horizontal direction in the plane of the attachment part 9 (specifically, in the height direction of the main unit case 3). Furthermore, the holding grooves 55 of the main unit case 3 hold the edges 53 of the antenna substrate 13, thereby restricting the movement of the antenna substrate 13 in the lateral or horizontal direction in the plane of the attachment part 9 (specifically, in the width direction of the main unit case 3). In this way, the antenna substrate 13 is also fixed to the main unit case 3 along with the waveguide substrate 11.

The antenna substrate 13 may be completely prevented from movement. Alternatively, the antenna substrate 13 may move to such an extent that the movement has no effect on the antenna performance. According to this embodiment, the latter state is also regarded as the "fixed state".

The electronic device with a built-in antenna according to this embodiment has been described. According to this embodiment, the waveguide substrate 11 is fixed to the attachment part 9, and the antenna substrate 13 is disposed to protrude from the attachment part. The inserts 33 on the waveguide substrate 11 are inserted into the slits 37 in the antenna substrate 13. Thus, the movement of the antenna substrate 13 is restricted by the waveguide substrate 11. Thus, the substrates 11 and 13 can be integrally assembled to the housing without using a metal plate bracket to couple the substrates 11 and 13 to each other.

In addition, according to this embodiment, the housing has the holding grooves 55 extending in a direction away from the attachment part 9, and the edges of the antenna substrate 13 are inserted in the holding grooves 55. Thus, the antenna substrate 13 is held by the holding grooves 55, so that the antenna substrate 13 is prevented from shaking. In addition, the holding grooves 55 serve also as guide grooves for guiding the antenna substrate 13 during assembly, so that the assembly is facilitated.

In addition, according to this embodiment, the inserts 33 on the waveguide substrate 11 have the engaging hooks 35. Thus, the antenna substrate 13 is hard to be disengaged from the waveguide substrate 11, and the substrates are appropriately fixed to the attachment part.

In addition, according to this embodiment, the antenna substrate 13 has the protrusion 45 at such a position that the protrusion 45 prevents the movement of the protrusion 41 on the waveguide substrate 11 in such a direction that the engaging hooks 35 are disengaged from the antenna substrate 13. Thus, the substrates 11 and 13 can be temporarily fixed to each other before the substrates are attached to the housing. Therefore, the substrates 11 and 13 can be easily assembled to the housing.

The waveguide substrate 11 and the antenna substrate 13 according to this embodiment correspond to one substrate and the other substrate according to the present invention, respectively. However, the antenna substrate may correspond to one substrate, and the waveguide substrate may correspond to the other substrate. In this case, the antenna substrate has inserts, and the waveguide substrate has slits. And, the antenna substrate is fixed to the housing.

A currently possible preferred embodiment of the present invention has been described above. However, it is to be understood that various modifications can be made to this embodiment, and all such modifications are included in the true scope and spirit of the present invention defined in the accompanying claims.

INDUSTRIAL APPLICABILITY

As described above, the electronic device with a built -in antenna according to the present invention has an advantage that the substrates can be integrally assembled to the housing without using a metal plate bracket, so that the antenna performance is improved, and is useful as a radio communication device or the like.

The invention claimed is:

1. An electronic device with a built-in antenna, comprising: a housing; and an antenna substrate and a waveguide substrate both incorporated in the housing, wherein one of said antenna substrate and said waveguide substrate is fixed to an attachment part in said housing, the other substrate is disposed adjacent to said one substrate and in a standing position on said attachment part, said one substrate has an insert on an edge thereof, said the other substrate has a slit formed therein along the edge of said one substrate, and said insert is inserted into said slit; wherein said insert on said one substrate has an engaging hook for engaging with said slit in said the other substrate; wherein said one substrate has a first protrusion that is aligned with said insert and protrudes from said edge, said the other substrate has a second slit aligned with said slit and a second protrusion extending from the edge of said second slit to the inside of said second slit, and said second protrusion on said the other substrate is disposed at such a position that the second protrusion restricts the movement of said first protrusion on said one substrate in such a direction that said engaging hook is disengaged.

2. The electronic device with a built-in antenna according to claim 1, wherein said housing has holding grooves extending in a direction away from said attachment part, and opposite edges of said the other substrate are inserted in said holding grooves.

3. The electronic device with a built-in antenna according to claim 1, wherein said one substrate is said waveguide substrate, and said the other substrate is said antenna substrate.

4. The electronic device with a built-in antenna according to claim 1, wherein said one substrate is said antenna substrate, and said the other substrate is said waveguide substrate.

5. An antenna unit incorporated in a housing, comprising: an antenna substrate; and a waveguide substrate coupled to said antenna substrate, wherein one of said antenna substrate and said waveguide substrate is fixed to an attachment part in said housing, the other substrate is disposed adjacent to said one substrate and in a standing position on said attachment part, said one substrate has an insert on an edge thereof, said the other substrate has a slit formed therein along the edge of said one substrate, and said insert is inserted into said slit; wherein said insert on said one substrate has an engaging hook for engaging with said slit in said the other substrate; wherein said one substrate has a first protrusion that is aligned with said insert and protrudes from said edge, said the other substrate has a second slit aligned with said slit and a second protrusion extending from the edge of said second slit to the inside of said second slit, and said second protrusion on said the other substrate is disposed at such a position that the second protrusion restricts the movement of said first protrusion on said one substrate in such a direction that said engaging hook is disengaged.

6. An electronic device with a built-in antenna, comprising: a housing; and a first substrate and a second substrate both incorporated in the housing, wherein said first substrate is fixed to an attachment part in said housing, said second substrate is disposed adjacent to said first substrate and in a standing position on said attachment part, said first substrate has an insert on an edge thereof, said second substrate has a slit formed therein along the edge of said first substrate, and said insert is inserted into said slit; wherein said insert on said first substrate has an engaging hook for engaging with said slit in said the second substrate; wherein said first substrate has a first protrusion that is aligned with said insert and protrudes from said edge, said the second substrate has a second slit aligned with said slit and a second protrusion extending from the edge of second slit to the inside of said second slit, and said second protrusion on said the second substrate is disposed at such a position that the second protrusion restricts the movement of said first protrusion on said first substrate in such a direction that said engaging hook is disengaged.

* * * * *